US009022103B2

(12) United States Patent
Roehm

(10) Patent No.: US 9,022,103 B2
(45) Date of Patent: May 5, 2015

(54) CAPTURE DEVICE FOR A BORE HOLE OF A FLUID SOURCE

(75) Inventor: Valentin Roehm, Munich (DE)

(73) Assignee: Valentin Roehm, Munich (DE)

( * ) Notice: Subject to any disclaimer, the term of this patent is extended or adjusted under 35 U.S.C. 154(b) by 34 days.

(21) Appl. No.: 13/883,301

(22) PCT Filed: Oct. 31, 2011

(86) PCT No.: PCT/EP2011/069164

§ 371 (c)(1),
(2), (4) Date: May 3, 2013

(87) PCT Pub. No.: WO2012/059475

PCT Pub. Date: May 10, 2012

(65) Prior Publication Data

US 2013/0220611 A1 Aug. 29, 2013

Related U.S. Application Data

(60) Provisional application No. 61/409,624, filed on Nov. 3, 2010.

(30) Foreign Application Priority Data

Nov. 3, 2010 (EP) ..... 10189806

(51) Int. Cl.
*E21B 43/00* (2006.01)
*E21B 43/01* (2006.01)

(52) U.S. Cl.
CPC ..... *E21B 43/00* (2013.01); *E21B 43/0122* (2013.01)

(58) Field of Classification Search
CPC .... E21B 43/0122; E21B 33/064; E21B 33/06
USPC ..... 166/81.1, 379; 137/315.02; 277/327; 251/1.2, 212
See application file for complete search history.

(56) References Cited

U.S. PATENT DOCUMENTS

| | | | | |
|---|---|---|---|---|
| 3,136,525 | A * | 6/1964 | Creasser | 251/212 |
| 5,116,017 | A * | 5/1992 | Granger et al. | 251/1.2 |
| 8,555,980 | B1 * | 10/2013 | Powell | 166/363 |
| 2009/0159273 | A1 * | 6/2009 | Guerrero | 166/250.01 |

FOREIGN PATENT DOCUMENTS

| | | |
|---|---|---|
| DE | 20 2010 009 812 | 10/2010 |
| DE | 20 2010 007 532 | 11/2010 |
| DE | 20 2010 010 994 | 12/2010 |

OTHER PUBLICATIONS

International Search Report of Nov. 30, 2011.

* cited by examiner

*Primary Examiner* — William P Neuder
*Assistant Examiner* — Richard Alker
(74) *Attorney, Agent, or Firm* — Gerald E. Hespos; Michael J. Porco; Matthew T. Hespos

(57) ABSTRACT

A capture device for a bore hole of a fluid source, has a base plate (6) that can be anchored at the floor, over the bore hole, and has a bore hole opening (8) through which fluid can be streamed out of the bore hole. An ascending pipe (2) is arranged over the bore hole opening (8). Guide baffles (9) are arranged around the bore hole opening (8), and have blades (10) fixed to the top of the base plate (6) so that the guide baffles (6) can be pivoted and displaced. The blades (10) encompass the longitudinal end (3) of the ascending pipe (2) that faces the bore hole opening (8) like a flower and overlap one another, whereby fluid flowing from the bore hole opening (8) can be captured via the blades (10) and discharged to the ascending pipe (2).

12 Claims, 5 Drawing Sheets

CAPTURE DEVICE FOR A BORE HOLE OF A FLUID SOURCE

BACKGROUND

1. Field of the Invention

The invention relates to a capture device for a bore hole of a fluid source.

2. Description of the Related Art

Petroleum and/or natural gas exist in a bubble in the ground in a petroleum and/or natural gas deposit. The bubble frequently is located below a cap rock that is gas- and/or fluid-tight, whereby a high pressure predominates in the bubble. To transport the petroleum and/or natural gas embedded in the bubble, it is known to install a bore into the cap rock via which an access to the bubble is established. To compensate for the high pressure in the bubble, a drilling fluid with a high density is filled into the bore hole during the drilling. The fluid column that thereby results generates a hydrostatic counter-pressure, whereby an uncontrolled escape of petroleum and/or natural gas from the bubble is suppressed. However, unwanted pressure increases in the bubble can occur in the drilling and in the later transport. If the deposit pressure is higher than the counter-pressure of the drilling fluid, petroleum and/or natural gas can penetrate into the bore hole, wherein the petroleum and/or the natural gas displaces the drilling fluid in the direction of the surface of the earth and ultimately itself reaches the surface as a blowout. In order to prevent (or at least dam) such a blowout, the bore hole must be sealed quickly. For this it is known to install a blowout preventer (bore seal) at the mouth of the bore hole. The blowout preventer is mounted at the bore and firmly anchored in the ground. The blowout preventer has a series of combined barrier devices that are mounted directly over the bore hole.

If the blowout preventer fails to stop the blowout of petroleum and/or natural gas, petroleum and/or natural gas arrives at the earth's surface without any control. The natural gas and/or petroleum that escapes from the bore hole is no longer available to be transported, whereby an economical loss occurs. However, it is more serious that a severe environmental pollution is incurred—primarily given the outflow of large quantities of petroleum and/or natural gas—that involves considerable ecological damage.

Bore holes have previously only been provided with the blowout preventer, wherein a disaster can occur upon its failure. In particular given bore holes in the deep sea, it is difficult to install the blowout preventer at significant depths and even more difficult to seal the bore hole again in the event of disaster. A redundant securing of the bore hole against the uncontrolled blowout of petroleum and/or natural gas in addition to the blowout preventer is not known.

It is an object of the invention to achieve a capture device for a bore hole of a fluid source, a method to secure the bore hole with the capture device and a use of the capture device to secure the bore hole, wherein the bore hole can be redundantly secured with the capture device in addition to a conventional device.

SUMMARY OF THE INVENTION

The capture device according to the invention for a bore hole of a fluid source comprises: a base plate that can be anchored at the floor over the bore hole and has a bore hole opening through which fluid can be streamed out of the bore hole; an ascending pipe that can be arranged over the bore hole opening; and a plurality of guide baffles arranged around the bore hole opening, which guide baffles respectively have a blade fixed to the top side of the base plate such that said guide baffles can be pivoted and displaced, such that—when the fluid source is in the normal state—the blades are in the passive state and are thereby arranged in a star shape around the bore hole opening on the base plate and are backed away from the bore hole; and—when the fluid source is in the disaster state—the blades are in the active state and are moved towards the bore hole opening and are deployed standing up from the base plate, and said blades encompass the longitudinal end of the ascending pipe that faces towards the bore hole opening like a flower and overlap one another, whereby fluid flowing from the bore hole opening can be captured by the blades and discharged to the ascending pipe. With the base plate the capture device can be attached to the bore hole without having to dismantle transport devices and barrier valves that are possibly already present.

The base plate could preferably be constructed in two parts consisting of two halves, wherein to install the base plate at the bore hole each half is placed on the ground at both sides of the bore hole and the two halves are then joined, whereby the base plate is formed and the bore hole opening is arranged over the bore hole. The capture device can thereby also be mounted at the bore hole when the fluid source is already in a disaster state. The capture device with its divided base plate can thereby be attached laterally at the bore hole, essentially in the lee of the fluid that is flowing out, such that the installation of the base plate halves takes place in that zone that is least negatively affected by the escaping fluid.

It is preferred that the blades respectively have a hinge for pivoting at the base plate, which hinge is directed such that it can be displaced horizontally on the base plate in a rail of the base plate that is associated with it. It is also preferred that, given the movement from the passive state into the active state, the guide baffles are first to be displaced horizontal to a raising location in the rails associated with them, which raising location is arranged at a distance from the bore hole; the guide baffles are then to be pivoted persistently around their hinges at the raising location until the blades stand up perpendicularly from the base plate and are thereby positioned; and the guide baffles are then to be displaced horizontally towards the ascending pipe in their associated rails.

The blades preferably have a respective blade surface that, when the blades are positioned, is perpendicular to the base plate and facing the bore hole opening, and have a sealing blade edge bounding the blade surface, which sealing blade edge has a line contact with the blade surface of the immediately adjacent blade when the blades are raised, whereby the blades are arranged adjoining one another and cylindrically overall around the bore hole opening. Each blade preferably has a back edge of the blade bounding the blade surface, which back edge of the blade faces away from the sealing blade edge and is arranged essentially parallel to this, wherein the width of the blade surface that is defined by the sealing bade edge and the back blade edge is so large that the guide baffles (positioned in the raised position) mutually contact at the blade surfaces with their sealing blade edges, whereby a closed cylinder is formed by the guide baffles around the bore hole opening. The course of the rails in the base plate is preferably formed such that the sealing blade edges always contact the blade surface of the adjacent blade when the guide baffles are directed up from the raising location to the ascending pipe. The curvature of the blade surfaces is preferably formed such that the sealing blade edges always contact the blade surface of the adjacent blade when the guide baffles are directed up from the raising location to the ascending pipe. If the blades are directed up from the raising location to the bore hole opening in the active state, an always tight cylindrical envelope around the bore hole is formed by the blades since the sealing edges always contact the blade surfaces of their respective adjacent blades. Upon directing the guide baffles to the ascending pipe, this is thus tightly enclosed by the guide baffles, whereby the fluid flowing out of the bore hole opening is guided to the ascending pipe with little leakage and in a directed manner.

During the raising of the guide baffles it is preferred that said guide baffles mutually overlap with contact so that the guide baffles match one another in terms of their shape during the positioning. It is thereby necessary that the blades are produced from a flexible material that has correspondingly suitable sliding properties at the contact points between the blades. It is preferable that these already overlap at their edges facing towards the base plate at the beginning of the raising of the guide baffles, such that the guide baffles mutually come into shape in the positioning. Alternatively, it is preferred that the guide baffles are free-standing while being raised and only mutually contact upon being in position. It is thereby possible that the guide baffles have a rigid construction that impart a high rigidity to the guide baffles.

The ascending pipe preferably comprises a collar made from deformable material at its longitudinal end facing towards the bore hole opening, which collar is adapted to the blades in the active state so that the blades rest in a fluid-tight manner against the ascending pipe. The material of the collar can preferably be elastically deformed by the blades upon application of said blades to the ascending pipe. In that the envelope of the blade surfaces in the active state of the blades is polygonal and is not exactly cylindrically shaped, gaps through which the fluid can escape would remain between the blades adjoining the ascending pipe and the ascending pipe itself. A sealing of the gaps is produced by means of the collar, whereby the fluid flowing out of the bore hole opening is directed via the guide baffles into the ascending pipe without leakage.

For raising the blades are preferably driven by a cable winch. As an alternative to this, a hydraulic drive for each of the guide baffles would be conceivable. It is also preferred that the blades are driven by a worm wheel drive to approach the ascending pipe.

The method according to the invention to secure the bore hole has the steps: anchor the capture device at the floor of the fluid source, wherein fluid can stream through the bore hole opening of the base plate; bring the guide baffles into the passive state, wherein the blades are arranged lying in a star shape on the base plate around the bore hole opening and are backed away from said bore hole opening; if the fluid source is in the disaster state, bring the blades into the active state, wherein the blades are moved towards the bore hole opening and are raised upward from the base plate into a standing position so that a cylinder arranged over the bore hole opening is formed by the blades, through which cylinder fluid flows from said bore hole; direct the ascending pipe to the capture device and insert the ascending pipe with its longitudinal end facing towards the bore hole opening into the cylinder formed by the blades; direct the blades towards the ascending pipe so that the longitudinal end of the ascending pipe facing towards the bore hole opening is encompassed by the blades which overlap one another like a flower, whereby fluid flowing from the bore hole opening is captured via the blades and discharged via the ascending pipe.

The blades are preferably cast with one another so that the blades are fixed at the ascending pipe. The capture device is thereby provided with a high structural strength and can withstand the strong mechanical stresses that possibly occur in the event of a disaster. The casting can preferably be conducted with a curing fluid (for example concrete) or a textile band impregnated with a curing fluid that is wound like a brace around the blades.

According to the invention the capture device is used to secure the bore hole of a petroleum and/or natural gas source. It is hereby preferred that a transport apparatus that is already installed at the bore hole is retrofitted.

The advantage of the capture device according to the invention is in particular that all attachment and installation processes can furthermore for the time being be implemented free of turbulent escaping fluid. Only in the slow closing (and thereby increasing through-conduction of the fluid) at the ascending pipe is the turbulent outflow converted continuously into a laminar flow, such a calmed outflow of the fluid is conducted into the ascending pipe. This leads to the reduction of the turbulence-induced disruptive forces, and thus to the naturally resulting reduction of the mechanical loading of the device.

The mounting of the capture device according to the invention can be installed at the outset in the opening up of the bore hole, wherein for example the bore hole seal is installed together with the capture device. It is likewise conceivable to install the capture device according to the invention at a later point in time in order to retrofit the bore hole with the capture device according to the invention. The capture device according to the invention can also only be installed at the bore hole as soon as the bore hole has gone into the disaster state. However, then conditions normally prevail at the bore hole in which the installation of the capture device according to the invention is more difficult than if the capture device had already been installed at the bore hole before the occurrence of the disaster.

In the following a preferred exemplary embodiment of a capture device according to the invention is explained using the attached schematic drawings.

BRIEF DESCRIPTION OF THE DRAWINGS

in FIG. 9 the guide baffles are arranged at the raising location and in FIG. 12 the capture device is in the active state.

DETAILED DESCRIPTION OF THE PREFERRED EMBODIMENTS

Figure 1:
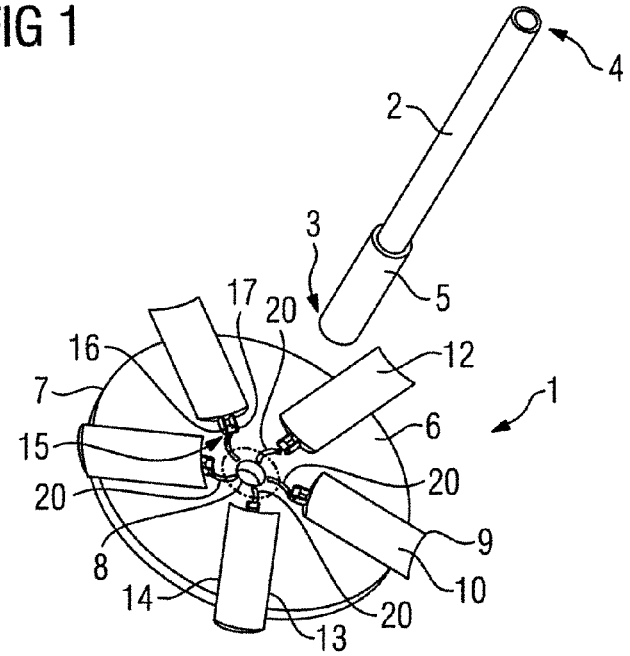
FIG. 1 a perspective view of the embodiment of the capture device in the passive state.
Figure 2:
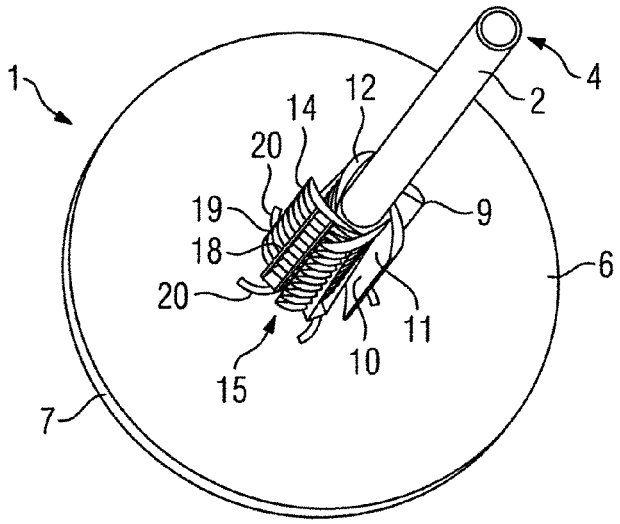
FIG. 2 a perspective view of the embodiment of the capture device in the active state.
Figure 3:
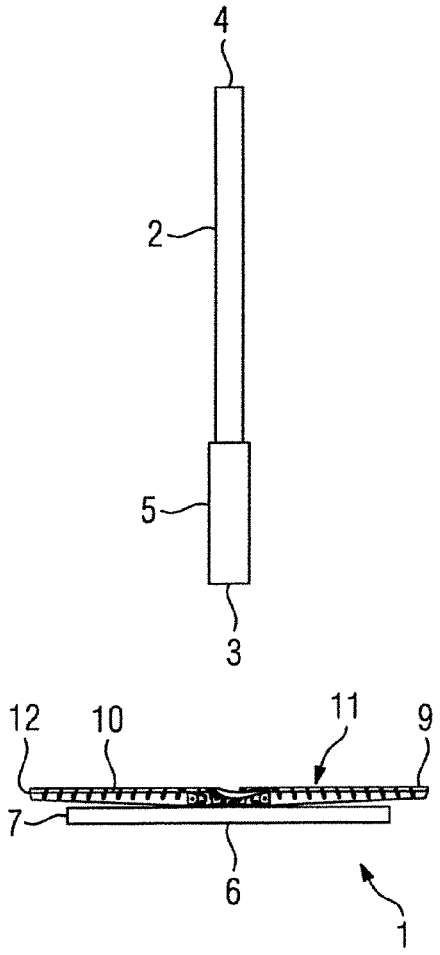
FIG. 3 a side view of the embodiment of the capture device in the passive state.
Figure 4:
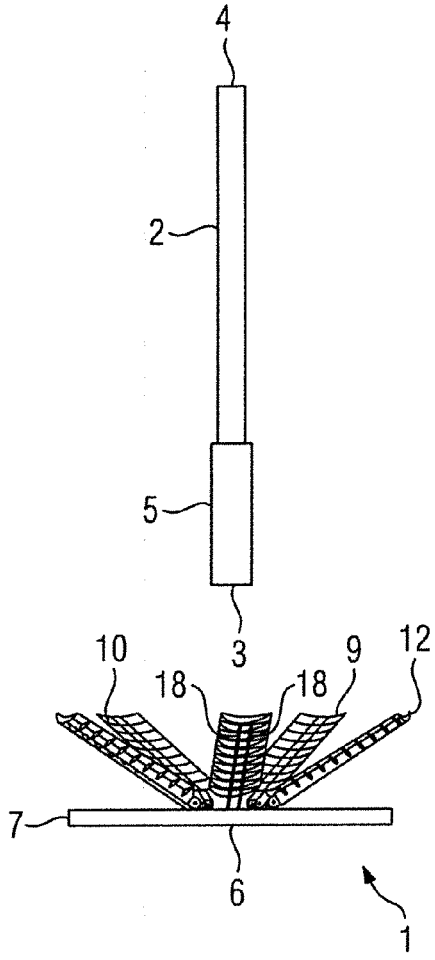
FIGS. 4 and 5 a side view of the embodiment of the capture device upon raising of guide baffles.
Figure 5:
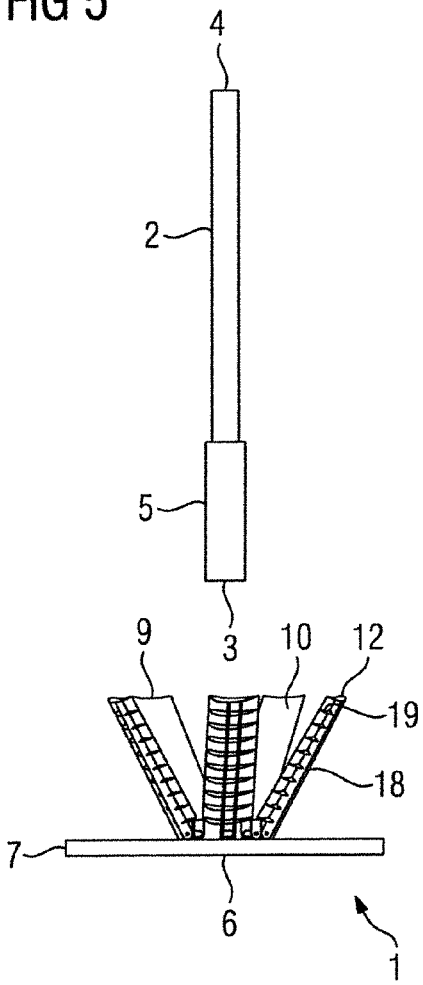
Figure 6:
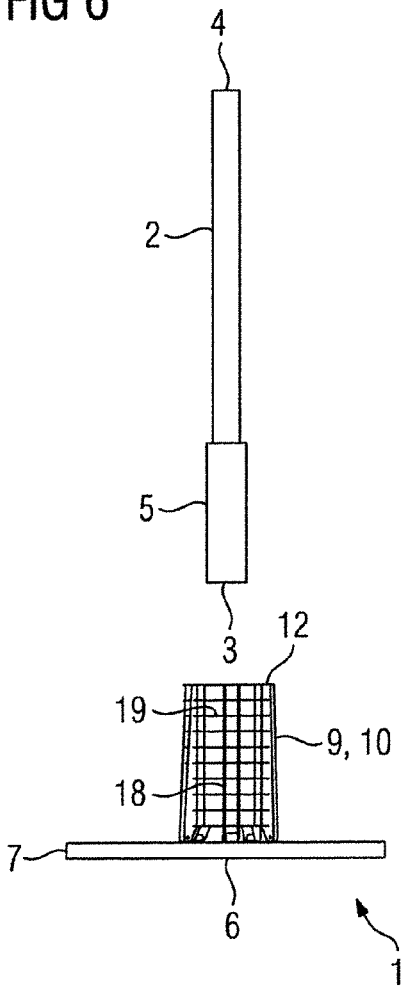
FIG. 6 a side view of the embodiment of the capture device with raised guide baffles in the raising location.
Figure 7:
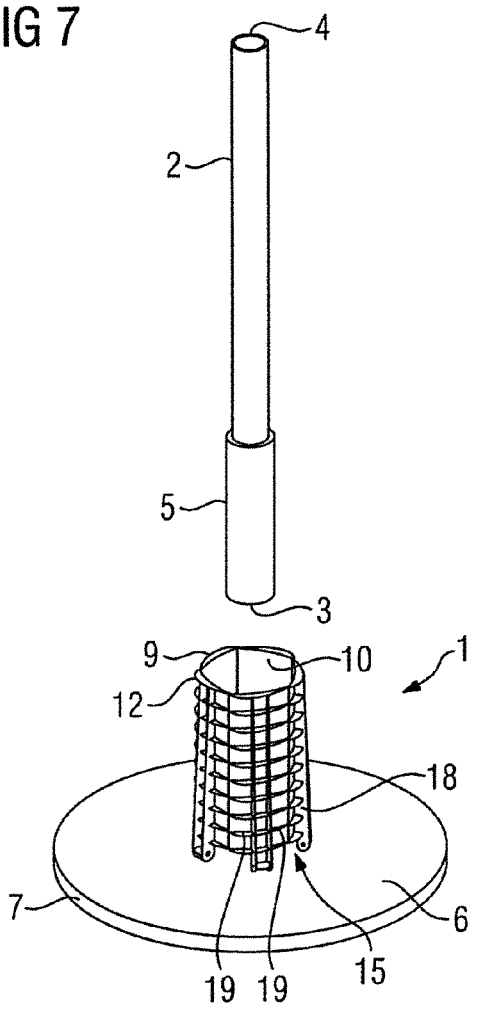
FIG. 7 a perspective view of the embodiment of the capture device with raised guide baffles in the raising location, wherein an ascending pipe is up.
Figure 8:
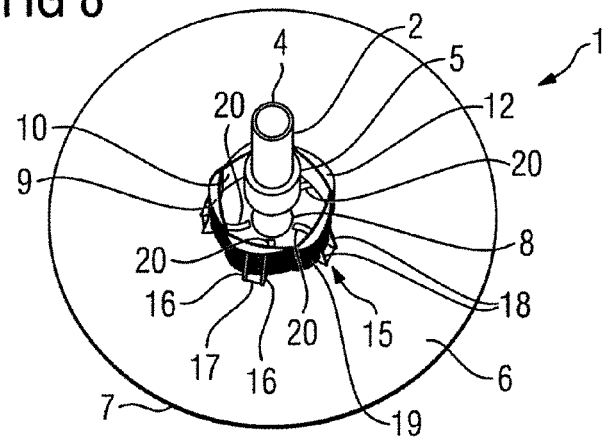
FIG. 8 a perspective view of the state of the embodiment of the capture device from FIG. 7, wherein the ascending pipe is inserted into the guide baffles.
Figure 9:
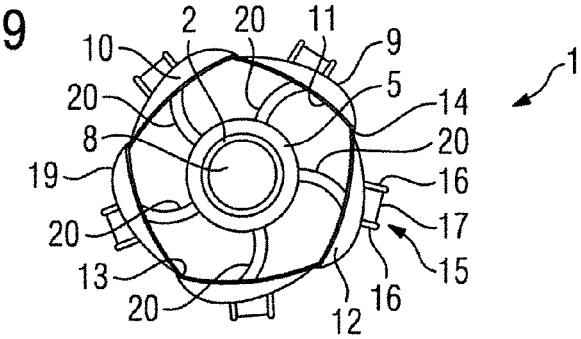
FIGS. 9 through 12 a series of plan views of the embodiment of the capture device, wherein the guide valves are directed towards the ascending pipe.
Figure 10:
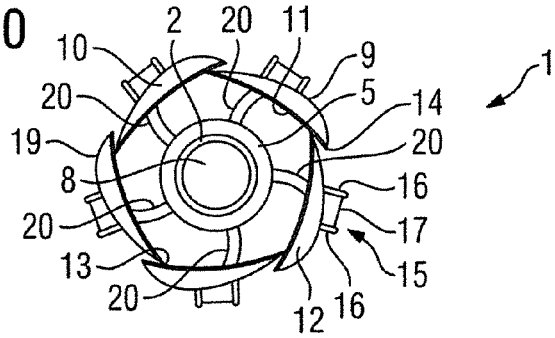
Figure 11:
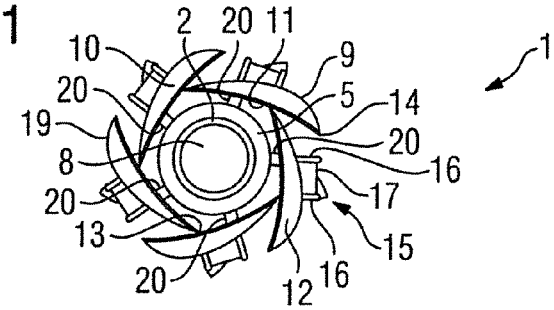
Figure 12:
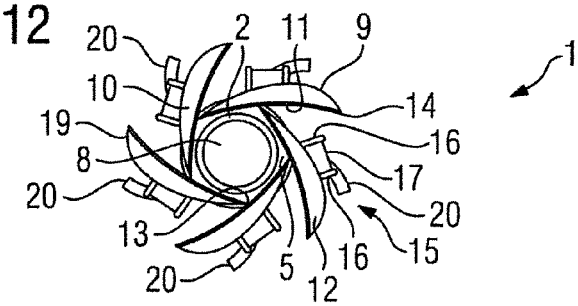

As is apparent from FIGS. 1 through 12, a capture device 1 comprises an ascending pipe 2 that has a lower longitudinal end 3 and an upper longitudinal end 4. A collar 5 is attached at the lower longitudinal 3 of the ascending pipe 2. A base plate 6 is arranged below the ascending pipe 2; the ascending pipe 2 runs essentially perpendicular to said base plate 6.

The base plate 6 has an outer edge 7 that is formed to be essentially circular. A bore hole opening 8 is provided in the center of the base plate 6. To install the capture device 1 over a bore hole (indicated with a dash-dot line) in deep ocean, the base plate 6 is to be arranged with its bore hole opening 8 over the bore hole, wherein the base plate 6 is to be anchored firmly in the floor. In the event of disaster of the source of the bore hole opening 8, the bore hole can be larger than the bore hole opening 8. For this the base plate 6 is constructed in two parts with two halves that can be attached separately to the bore hole and be connected firmly with one another for installation of the base plate 6. The ascending pipe 3 is arranged over the bore hole opening 8, wherein the center of the bore hole opening 8 lies on the axis of the ascending pipe 2 and in a continuation of an outflow from the damaged bore hole.

Five guide baffles 9 that are respectively formed by a blade 10 are provided at the top side of the base plate 6. The blades 10 have a rectangular blade surface 11 with concave curvature across their short side, wherein in the passive state of the capture device 1 the guide baffles 9 are arranged around the bore hole opening 8 so that the blades 10 are arranged in a star shape around said bore hole opening 8 and are situated on the base plate 6. The blade surfaces 11 of the blades 10 are hereby arranged facing away from the base plate 6 and point with their longitudinal sides away from the bore hole opening 8, wherein the short side of the blade surfaces 11 that is facing away from the bore hole opening 8 forms a blade tip 12.

The blades 10 respectively have a sealing blade edge 13 on their longitudinal sides which are arranged counter-clockwise, wherein the longitudinal side of the blade surfaces 11 that are opposite the sealing blade edge 13 forms a back blade edge 14. The short side of the blade 10 that faces away from the blade top 12 has a hinge 15 that is formed by two hinge eyes 16 and a hinge bushing 17. At the hinge eyes 16, two reinforcement webs 18 that extend across the entire longitudinal side of the blades 10 are formed at the back side of the blades that face away from the blade surface 11. A plurality of reinforcement ribs 19 are provided on the back side of the blades 10, transversal to the reinforcement webs 18.

A rail (20) is respectively provided for each guide baffle 9 in the top side of the base plate 6, with which rail each guide baffle 9 can be longitudinally displaced on its hinge 15. In terms of their course the rails are formed in the base plate 6 such that the guide baffles 9 can be converted from the passive state into the active state and back. Respective worm wheel drives are provided in the guide rails, wherein a rotatable threaded rod is housed in each rail, for example, which threaded rod engages in a thread that is applied in the hinge 15 engaging in the rail, whereby the guide baffle 9 can be longitudinally displaced in the rail on the base plate 6.

In the passive state of the capture device 1 the guide baffles 9 lie on the base plate 6, wherein the blade surfaces 11 point upward. Upon conversion of the capture device 1 from the passive state into the active state, the guide baffles 9 (which are in a star shape) are first to be brought linearly in the rails towards the bore hole opening 8 until the guide baffles 9 are in a raising location. The guide baffles 9 persist in the raising location and are pivoted upward via their hinges 15 until the guide baffles 9 project upwards from the base plate 6 and the blade surfaces 11 run perpendicular to said base plate 6. The adjacent guide baffles 9 thereby touch one another, whereby each sealing blade edge 13 has a physical contact with the blade surface 11 of the guide baffle 9 that is adjacent to it. The radial distance from the bore hole opening 8 of the raising location is defined by this state of the guide baffles 9.

From the raising location the guide baffles 9 are brought into the active state, wherein the guide baffles 9 are brought towards the ascending pipe 2 until the guide baffles with their blade surfaces 11 adjoin the collar 5 of the ascending pipe in a fluid-tight manner. Upon direction of the guide baffles 9 onto the ascending pipe 2, the blade edges 13 always contact their adjacent blade surfaces 11. Due to the curvature of the blade surfaces 11, a spiral path on the base plate 6 results from this for the guide baffles 9, according to which path the rails are formed from the raising location to the end position of the guide baffles in the active state.

The collar 5 is produced from an elastically deformable material so that the collar 5 is deformed, adapted to the envelope of the blade surfaces 11, upon being surrounded by the guide baffles 9.

To raise the guide baffles 9 at the raising location, a cable winch (not shown) is provided with which the guide baffles 9 are raised together by means of a cable. After the guide baffles 9 are raised at the raising location, the ascending pipe 2 that is initially arranged outside of the guide baffles 9 is driven with its lower longitudinal end 3 into the cylinder formed from the guide baffles 9.

The invention claimed is:

1. A capture device for a bore hole of a fluid source comprising: a base plate (6) that can be anchored at a floor, over the bore hole, and a bore hole opening (8) through which fluid can be streamed out of the bore hole; an ascending pipe (2) that can be arranged over the bore hole opening (8); and a plurality of guide baffles (9) arranged around the bore hole opening (8), the guide baffles respectively have a blade (10) fixed to a top side of the base plate (6) such that said guide baffles (6) can be pivoted and displaced, such that, when the fluid source is in a normal state, the blades (10) are in a passive state and are thereby arranged in a star shape around the bore hole opening (8) on the base plate (6) and are backed away from the bore hole (8); and, when the fluid source is in a disaster state, the blades (10) in the active state are moved towards the bore hole opening (8) and are deployed standing up from the base plate (6), and said blades (10) encompass the longitudinal end (3) of the ascending pipe (2) that faces towards the bore hole opening (8) and overlap one another, whereby fluid flowing from the bore hole opening (8) can be captured via the blades (10) and discharged to the ascending pipe (2).

2. The capture device of claim 1, wherein the blades (10) respectively comprise a hinge (15) for pivoting at the base plate (6), which hinge (15) is directed such that it can be displaced horizontally on the base plate (6) in a rail of the base plate (6) that is associated with it.

3. The capture device of claim 2, wherein given the movement from the passive state into the active state the guide baffles (9) are first to be displaced horizontal to a raising location in the rails associated with them, which raising location is arranged at a distance from the bore hole opening (8); the guide baffles (9) are then to be pivoted persistently around their hinges at the raising location until the blades (10) stand up perpendicularly from the base plate (6) and are thereby raised; and the guide baffles (9) are then to be displaced horizontally towards the ascending pipe (2) in their associated rails.

4. The capture device of claim 3, wherein the blades (10) comprise a respective blade surface (11) that, when the blades (10) are raised, is facing perpendicular to the base plate (6) and the bore hole opening (8), and comprise a sealing blade edge (13) bounding the blade surface, which sealing blade edge (13) has a line contact with the blade surface (11) of the immediately adjacent blade (10) given raised blades (10), whereby the blades (10) are arranged adjoining one another and cylindrically overall around the bore hole opening (8).

5. The capture device of claim 4, wherein each blade (10) comprises a back edge (14) of the blade bounding the blade surface (11), which back edge (14) of the blade faces away from the sealing blade edge (13) and is arranged essentially parallel to this, wherein the width of the blade surface (11) that is defined by the sealing bade edge (13) and the back blade edge (14) is so large that the guide baffles (9) raised at the raising location mutually contact at the blade surfaces (11) with their sealing blade edges (13), whereby a closed cylinder is formed by the guide baffles (9) around the bore hole opening (8).

6. The capture device of claim 5, wherein the course of the rails in the base plate (6) is formed such that the sealing blade edges (13) always contact the blade surface (11) of the adjacent blade (10) when the guide baffles (9) are directed up from the raising location to the ascending pipe (2).

7. The capture device of claim 5, wherein the curvature of the blade surfaces (11) is formed such that the sealing blade edges (13) always contact the blade surface of the adjacent blade when the guide baffles (9) are directed up from the raising location to the ascending pipe (2).

8. The capture device of claim 1, wherein during the raising of the guide baffles (9) the guide baffles (9) mutually overlap with contact so that the guide baffles (9) match one another in terms of their shape during the raising.

9. The capture device of claim 1, wherein the guide baffles (9) are free-standing while being raised and only mutually contact upon being in fully raised.

10. The capture device of claim 1, wherein the ascending pipe (2) comprises a collar (5) made from deformable material at its longitudinal end (3) facing towards the bore hole opening (8), the collar (5) being adapted to the blades (10) in the active state so that the blades (10) rest in a fluid-tight manner against the ascending pipe (2).

11. A method to secure a bore hole of a fluid source, with the steps:

anchoring the capture device (1) according to claim 1 at the floor of a fluid source, wherein fluid can stream through the bore hole opening (2) of the base plate (6);

bringing the guide baffles (9) into the passive state, wherein the blades (10) are arranged lying in a star shape on the base plate (6) around the bore hole opening (8) and are backed away from said bore hole opening (8);

if the fluid source is in the disaster state, bringing the blades (10) into the active state, wherein the blades (10) are moved towards the bore hole opening (8) and are raised upward from the base plate (6) into a standing position so that a cylinder arranged over the bore hole opening (8) is formed by the blades (10), through which cylinder fluid flows from said bore hole;

directing the ascending pipe (2) to the capture device (1) and inserting the ascending pipe (2) with its longitudinal end (3) facing towards the bore hole opening (8) into the cylinder formed by the blades (10);

directing the blades (10) towards the ascending pipe (2) so that the longitudinal end (3) of the ascending pipe facing towards the bore hole opening (8) is encompassed by the blades (10) which overlap one another like a flower, whereby fluid flowing from the bore hole opening (8) is captured via the blades (10) and discharged via the ascending pipe (2).

12. The method of claim 11, further comprising casting the blades (10) with one another so that the blades (10) are fixed at the ascending pipe (2).

* * * * *